United States Patent [19]

Bartholic et al.

[11] 4,435,272

[45] Mar. 6, 1984

[54] PROCESS FOR UPGRADING CRUDE OIL AND RESIDUAL FRACTIONS THEREOF BY VAPORIZING THE CHARGE IN A FALLING CURTAIN OF CONTACT PARTICLES

[75] Inventors: David B. Bartholic, Watchung, N.J.; Robert L. Flanders, San Anselmo, Calif.

[73] Assignee: Engelhard Corporation, Edison, N.J.

[21] Appl. No.: 369,056

[22] Filed: Apr. 16, 1982

[51] Int. Cl.[3] ..... C10G 9/30; C10G 9/42

[52] U.S. Cl. ..... 208/127; 208/167; 208/251 R; 422/216

[58] Field of Search ..... 208/127, 167, 251 R; 422/216

[56] References Cited

U.S. PATENT DOCUMENTS 2,548,912 4/1951 Savage ..... 208/167

2,766,189 10/1956 Shimp ..... 422/216

4,263,128 4/1981 Bartholic ..... 208/251 R

*Primary Examiner*—Delbert E. Gantz

*Assistant Examiner*—Lance Johnson

*Attorney, Agent, or Firm*—Inez L. Moselle

[57] ABSTRACT

A process for upgrading a petroleum charge of crude oil or residual fractions thereof, in which the charge is dispersed into a descending curtain of heated, substantially inert contact material. This contact material preferably has a conversion rate not substantially greater than 10% in the CAT D test. The vapors generated on contact of the charge with the curtain are collected on the side of the curtain opposite from where the charge is dispersed. The recovered product has a substantially reduced metals content and Conradson Carbon number and is suitable for catalytic cracking or use as heavy fuel or a heavy fuel precursor.

16 Claims, 2 Drawing Figures

PROCESS FOR UPGRADING CRUDE OIL AND RESIDUAL FRACTIONS THEREOF BY VAPORIZING THE CHARGE IN A FALLING CURTAIN OF CONTACT PARTICLES

FIELD OF THE INVENTION

The invention is concerned with increasing the portion of heavy petroleum crudes which can be utilized as high quality heavy fuel or as catalytic cracking feed stock to produce premium petroleum products, particularly motor gasoline of high octane number. More particularly, this invention relates to an improved process for selective vaporization of petroleum and residual fractions thereof, which process results in a reduction of Conradson Carbon values, salt content and metal content to levels tolerable in catalytic cracking, hydrotreating, or hydrocracking and to apparatus especially suited for carrying out the inventive process.

BACKGROUND OF THE INVENTION

The crude oil from which gasoline and other liquid hydrocarbon fuels are derived generally comprises a diverse mixture of hydrocarbons and other compounds which boil over a wide range. Those components boiling at the lower end of this range (between about 100° and 650° F.) are in many cases recovered from the crude oil by atmospheric distillation. The higher molecular weight, high boiling components of crude oil, however, are not directly suitable for use in gasoline or other premium liquid hydrocarbon fuels.

In order to maximize the desired product yield from the crude, the petroleum refining industry has developed processes for cracking the higher molecular weight components into smaller molecules which boil over a lower temperature range. Among the most widely used of these methods is that known in the industry as fluid catalytic cracking (FCC). In the generalized FCC process, a vaporized hydrocarbon feedstock is contacted at an elevated temperature with a cracking catalyst. When the desired degree of cracking has been achieved, the vapor product is separated from the catalyst. The catalyst containing carbonaceous deposits is sent to a regenerator. In the regenerator the carbon is removed by burning in air and the catalyst activity restored. The catalyst is then generally recycled for the treatment of additional feedstock.

Crude oil usually contains a variety of components in varying amounts which reduce the efficiency of FCC processes. Among these are coke precursors (asphaltenes, polynuclear aromatics, etc.), heavy metals (nickel, iron, copper, vanadium, etc.) and lighter metals (sodium, potassium, etc.). The lighter metals can often be removed economically by conventional desalting operations forming a part of the standard pretreatment of crude oil prior to use in catalytic cracking or in the preparation of the heavier fuels; in some cases, however, caustic soda is used for corrosion control, which may lead to further sodium contamination. The coke precursors and heavy metals generally have been more troublesome.

The heavy ends of many crudes are particularly high in coke precursors and heavy metals which are undesirable in catalytic cracking feed stocks and in products such as heavy fuel, where ash specifications are sometimes important. The undesirable coke precursors and metal-bearing compounds present in the crude tend to become concentrated in the residues of atmospheric and vacuum distillations, commonly called atmospheric and vacuum residua or "resids", because most of them are of high boiling point. The present invention provides an economically attractive method for selectively removing and utilizing these undesirable components from whole crudes and from resids.

As used herein, the terms "residual stocks", "resids" and similar terminology include any petroleum fraction remaining after fractional distillation to remove some more volatile components. In that sense, "topped crude" remaining after distilling off gasoline and lighter fractions is a resid.

When catalytic cracking was first introduced in the petroleum industry during the 1930's, the process constituted a major advance over the previous techniques for increasing the yield of motor gasoline from petroleum. Today, the catalytic cracker is the dominant unit of a petroleum refinery. As installed capacity of catalytic cracking has increased, there has been increasing pressure to charge to these units greater proportions of the crude entering the refinery. Two very effective restraints have limited the extent to which this has been practicable, particularly in existing FCC's: the coke precursor content and the heavy metals content of the feed. As these values rise, the capacity and efficiency of the catalytic cracker are adversely affected.

Polynuclear aromatics, asphaltenes and other coke precursors tend to break down during the catalytic cracking process to form coke. This coke deposits on the active surface of the catalyst, thereby reducing its activity level. In general, the coke-forming tendency or coke precursor content of an oil can be ascertained by determining the weight percent of carbon remaining after a sample of that oil has been pyrolyzed. This value is accepted in the industry as a measure of the extent to which a given feedstock tends to form coke when treated in a catalytic cracker. One of the accepted methods for making this evaluation is the Conradson Carbon test. When a comparison of catalytic cracking feedstocks is made, a higher Conradson Carbon number (CC) reflects an increase in the portion of the charge converted to "coke" deposited on the catalyst.

It has been conventional to burn off the inactivating coke with air to "regenerate" the active surfaces, after which the catalyst is returned in cyclic fashion to the reaction stage for contact with and conversion of additional feedstock. The heat generated in the burning regeneration stage is recovered and used, at least in part, to supply heat for vaporization of the feedstock and for the cracking reaction.

The regeneration stage generally operates under a maximum temperature limitation in order to avoid heat damage to the catalyst. Since the rate of coke burning is a function of temperature, it follows that in any regeneration stage there is a limit to the amount of coke which can be burned in unit time. As CC of the charge stock is increased, coke-burning capacity becomes the limiting factor, often requiring a reduction in the rate of charge to the unit. Moreover, part of the charge has been diverted to an undesirable reaction product, reducing the efficiency of the process.

Metal-bearing fractions contain, inter alia, the heavy metals nickel and vanadium. When present in the charge, these metals are deposited almost quantitatively on the catalyst as the molecules in which they occur are cracked. The deposits of these metals build up over repeated cracking cycles to levels which become very troublesome. Some of these metals unfavorably alter the chemical composition of the catalyst. For example, vanadium tends to form fluxes with certain components of common FCC catalysts, lowering their melting point to the degree that sintering begins at FCC operating temperatures.

The heavy metals present in crude oils are also potent catalysts for the production of coke and hydrogen from the cracking feedstock. The lowest boiling fractions of the cracked product—butane and lighter—are processed through fractionation equipment to recover components of greater value than as fuel for the furnaces. This fraction comprises primarily propane, butane and olefins of like carbon number. Hydrogen, being incondensible in the "gas plant", occupies space as a gas in the compression and fractionation train. When an excessive amount is produced by high metal-content catalyst, this can easily overload the system, causing a reduction in the charge rate at which the catalytic cracking unit and auxiliaries remain operative.

In heavy fuels used in stationary furnaces, turbines and large stationary and marine diesel engines, quality is a significant factor. The overall quality of heavy fuels such as Bunker Oil and heavy gas oils is adversely affected as it becomes necessary to prepare these from crudes of high CC, metals and salt contents. An additional complication is that petroleum ash, particularly that containing vanadium and sodium, attacks furnace refractories and turbine blades.

These problems have long been recognized in the art and many expedients have been proposed. One approach uses thermal conversion producing large quantities of solid fuel as coke. This type of process has therefore been characterized as "coking". Two varieties are presently practiced commercially. One is known as delayed coking, in which the feed is heated in a furnace and passed to large drums maintained at 780°–840° F. During a long residence time at this temperature, the charge is converted to coke and distillate products are taken off the top of the drum for recovery of "coker gasoline", "coker gas oil" and gas. The other variety of coking process now in use employs a fluidized bed of coke in the form of small granules at about 900° to 1050° F. The resid charge undergoes conversion on the surface of the coke particles during a residence time on the order of two minutes, depositing additional coke on the surfaces of the particles in the fluidized bed. Coke particles are transferred to a bed fluidized by air to burn some of the coke at temperatures upwards of 1100° F.; the thus-heated residual coke is then returned to the coking vessel for conversion of additional charge.

Coking does reduce metals and Conradson carbon in the production of a distillate from residuum. The distillate, however, is refractory for subsequent conversion or desulfurization processes. Moreover, coking produces a coke product high in sulfur and ash, and thus of poor quality. Typically, petroleum coke sells for 1/5 its heat value.

The known coking processes induce extensive thermal cracking of components which would be valuable as FCC charge, resulting in the production of gasoline of lower octane number than would be obtained by catalytic cracking. The gas oils produced are olefinic, containing significant amounts of diolefins which are prone to degradation to coke in furnace tubes and on cracking catalysts. It is, therefore, often desirable to treat these gas oils by expensive hydrogenation techniques before charging to catalytic cracking or blending with other fractions for fuels.

Catalytic charge stock and fuel stocks may also be prepared from resids by "deasphalting", in which an asphalt precipitant such as liquid propane is mixed with the oil. Metals and Conradson Carbon levels are significantly reduced, but a low yield of deasphalted oil is recovered.

Solvent extractions and various other techniques have also been proposed for preparation of FCC charge stock from resids. Solvent extraction, in common with propane deasphalting, functions by chemical selection, rejecting from the charge stock aromatic compounds which can crack to yield high octane components of cracked naphtha. Low temperature, liquid phase sorption on catalytically inert silica gel has also been proposed (Shuman and Brace, Oil and Gas Journal, p. 113 (Apr. 6, 1953)).

In the 1950's, much work centered on the so-called Houdresid process for the conversion of crude oils into gasoline and other products. This type of process employed catalyst particles of a "granular" size substantially larger than the typical FCC catalyst particles in a compact gravitating bed. In spite of a low yield of product relative to fluid catalytic cracking of lighter gas oils, the Houdresid process offered the advantage of a decreased process sensitivity to high metals level. The heavy metals accumulating on the surfaces of the catalyst particles were apparently removed to some extent by an attrition process, whereby the outer layers of metal-contaminated catalyst were removed. Nonetheless, the Houdresid process is also unsatisfactory in terms of both economy and productivity.

U.S. Pat. Nos. 2,462,891 and 2,378,531 disclose processes utilizing a solid heat transfer medium to vaporize and preheat catalytic cracking charge stock. Heat from a catalytic regenerator is employed. The object of these processes is to vaporize the total quantity of a catalytic charge stock. It is, however, recognized that a heavy portion of the charge may remain in liquid state and be converted to vaporized products of cracking and coke by prolonged contact with the heat transfer material, a conversion related to the coking processes earlier noted. The use of solid heat transfer agents to induce extensive cracking of hydrocarbon charge stocks at the high temperatures and short reaction times which maximize ethylene and other olefins in the product has also been disclosed. An example of such teachings is U.S. Pat. No. 3,074,878.

U.S. Pat. No. 2,472,723 proposes the addition of an adsorptive clay to the charge for a catalytic cracking process. The clay is used on a "once-through" basis to adsorb the polynuclear aromatic compounds which are believed to be coke precursors and thereby reduce the quantity of coke deposited on the active cracking catalyst also present in the cracking zone.

U.S. Pat. No. 4,263,128 discloses a process for upgrading petroleum and residual fractions thereof, in which whole crude and bottoms fractions from distillation of petroleum are upgraded by high-temperature, short-time contact with a fluidizable solid of essentially inert character to deposit high boiling components of the charge on the solid. In this manner, Conradson Carbon values, salt content and metal content are reduced to levels tolerable in catalytic cracking. The upgraded hydrocarbon fraction may be supplied to a fractionator. The high temperature contactor thus serves as heater for the crude, in addition to improving the quality of the fractions derived by distillation. The disclosed process calls for the use of an inert solid of low surface area of a size of about 20 to 150 micron particle diameter, which is mixed with the resid or petroleum charge in a riser. The oil is introduced at a temperature below the thermal cracking temperature in admixture with steam and/or water to reduce the partial pressure of volatile components of the charge. The catalytically-inert solid is supplied to a rising column of charge at a temperature and in an amount such that the mixture is at a temperature of upwards of 700° F. to 1050° F., which is sufficient to vaporize most of the charge. The process is preferably conducted in a contactor very similar in construction and operation to the riser reactors employed in modern FCC units.

Co-pending U.S. patent application Ser. No. 299,361 discloses a selective vaporization process in which heavy charge stocks such as whole crudes, topped crudes, resids and the like are contacted with an inert, finely divided solid material in a confined vertical column under suitable conditions to deposit heavy components of high CC and/or metal content on the solids and vaporize other components of the charge. Various hydrocarbons are separated at the top of the column from inert solids bearing the unvaporized components as a deposit thereon. The vapors are promptly cooled to a temperature below that at which substantial thermal cracking occurs and are processed as desired in a catalytic cracker or the like. According to some embodiments of the process, contact is effected in a riser. In other embodiments, a rising column of inert solids in steam, hydrocarbon gases or mixtures of the two is established and the direction of flow is subsequently reversed to a confined descending column into which the charge is injected.

Although both U.S. Pat. No. 4,263,128 and U.S. patent application Ser. No. 299,361 disclose processes which provide results superior to the prior art methods for upgrading petroleum or residual fractions thereof, the industry for obvious reasons is constantly searching for methods which maximize the yield of high-hydrogen petroleum components and minimize coke deposits. In particular, minimization of the contact time between the petroleum charge and the contact material to that period which would allow for essentially no cracking of high-hydrogen components is a major goal of selective vaporization processes. In addition, the best possible stripping and rapid disengagement of the petroleum charge from the contact material would maximize liquid yield and facilitate control of burner temperatures below their metallurgical limit. A minimization of contact material abrasion and plant erosion due to contact material circulation is also desirable.

In spite of the improvements achieved through the selective vaporization processes described above, it has been very difficult in practice to get the absolute minimum contact times and the desired intimate mixing in some existing riser contactor units. This is because of mechanical limitations of some typical contactor units, which in general comprise a vertical conduit enclosing the hydrocarbons, diluents and fluidizable contact material. First, the correct hydraulics are necessary to ensure proper circulation. After adjustment of the burner and contactor pressures, however, a vertical conduit contact of such great length may be required that one often needs multiple injection and gas recycle systems to achieve the desired minimum contact times. The use of a hydrocarbon gas recycle obviously places an additional power load on the system. Multiple injection systems do result in lower contact times, but increase utility requirements. In a vertical upflow conduit contactor, there is also generally some slippage of the contact materials, increasing the contact time. Moreover, it may be difficult to get the desired intimate mixing in some systems. The hydrocarbon feedstock is normally injected vertically into the center of the conduit with the contact material on the periphery, or the feedstock is injected around the periphery of the conduit with the contact material in the center. Neither of these commonly employed methods necessarily provides optimum mixing.

In conclusion, an ideal system for upgrading petroleum feed stocks would achieve the following goals: (1) an immediate vaporization of the high hydrogen, low boiling components; (2) an optimum reaction time on the surface of the contact material for the heavier hydrocarbon components and metal bearing compounds; (3) a retention of the metals by the contact material, with a minimization of "poisoning"; (4) an optimum degree of "cracking" of the higher hydrocarbon components with a minimization or elimination of cracking of the lighter hydrocarbons; and (5) a rapid condensation of the uncracked hydrocarbon vapors free of metals and carbonaceous materials.

SUMMARY OF THE INVENTION

The instant invention is a modification of the processes and apparatus described in U.S. Pat. No. 4,263,128 and U.S. application Ser. No. 299,361, which modification results in a minimization of contact time and a maximization of desired product yield. This is achieved through the following process features:

(1) In place of the prior art fluidizable contact materials, a non-fluidizable contact material of a shape and size which do not allow for fluidization at the resulting vapor velocities in the contactor but do permit a downward movement of the contact material at a controlled rate is employed.

(2) The contact material is dropped in a vertical curtain around the oil inlet, which disperses the hydrocarbon feedstock into the curtain of contact material. When the oil drops contact this curtain of contact material, the high hydrogen components of the hydrocarbon feed vaporize instantly.

(3) The vaporized hydrocarbon materials are withdrawn in a uniform manner on the opposite side of the curtain of contact material. In particular, this withdrawal may be made at or near the top head of the contactor vessel.

(4) The resultant hydrocarbon vapors exiting the contactor are rapidly condensed or "quenched", yielding a hydrocarbon liquid essentially free of metals and carbonaceous materials.

The inventive method provides a "syncrude" which is an excellent feed for conventional catalytic refining processes. The heavier, higher molecular weight hydrocarbons and metal-bearing compounds are deposited on the contact material and are given more time to react therewith. The result is that the metals remain bound to the surface of the contact material and the higher molecular weight compounds are partially thermally cracked to a lighter, more desirable product.

A curtain of contact material has been employed in catalytic cracking systems to prevent passage of vapor or liquid feed to the interior wall surface of the housing. This type of system is described, for example, in U.S.

Pat. No. 2,548,912. A receptacle is located at the top of the contactor or catalytic cracker into which heated contact material is introduced. From this receptacle, the contact material is fed into a suitable means for forming the annular curtain of contact material.

The above-noted U.S. Pat. No. 2,548,912 and similar disclosures of the use of an annular curtain of contact material have focused primarily on the use of such an arrangement in the catalytic cracking of hydrocarbon feed similar to that carried out in FCC systems. In this regard, therefore, the use of a curtain of contact material is the direct opposite of the instant invention, in which catalytic cracking of the vapors is eliminated or minimized. The instant invention, moreover, contemplates a passage of essentially all of the vapors through the curtain of contact material to outlet pipes located on the side of said curtain opposite from the input of feedstock. In the systems exemplified by U.S. Pat. No. 2,548,912, however, the purpose of the curtain of contact material is precisely to prevent the passage of material to any point external to said curtain.

Another significant difference between the systems such as disclosed in U.S. Pat. No. 2,548,912 and those of the invention is the location of the vapor outlet pipes. Since the former aim for a maximization of cracking of the hydrocarbon feed, the vapor outlets are located below the bed of contact material formed at the base of the contactor as the contact material descends in curtain form. According to the invention, however, a cracking of the vapors is to be avoided to the extent possible. The vapor outlets, accordingly, are located so as to remove vapors immediately upon formation, and preferably are located at or near the top of the contactor.

In fact, the instant invention allows for the productive use, after some modifications, of existing Houdresid-type units which are no longer operational. There are currently in existence a substantial number of Houdresid units and others of similar design which, because of their limited productivity, have been abandoned in favor of other methods for the catalytic cracking of petroleum feedstocks. When modified according to the instant invention, however, these units may be economically employed for the selective vaporization of crude oil and residua thereof. Accordingly, it is a particular advantage of the instant invention that it provides an opportunity for recoupment of the substantial capital investments made in these Houdresid-type systems.

In general, the inventive process is carried out under temperatures and pressures corresponding to those currently used in selective vaporization systems. The contact material is generally heated above about 1100° F.; the upper temperature limit is determined by the particular burner employed and rarely exceeds 1600° F. When impacted by the charge, the contact material has in most cases a temperature of at least 800° F.; temperatures in the range of 900°–1050° F. are preferred. The operating pressures in the system are preferably as low as possible. This pressure rarely exceeds 30 psi, and is usually about 10–15 psi.

The vertical curtain of contact material is kept to the minimum possible thickness; at most, this would be a few inches. If desired, the feedstock may be injected mixed with steam. As it is impacted by the oil droplets being dispersed into the curtain, the contact material is pushed slightly away from the source of the feedstock. The angle at which the oil is dispersed into the curtain may vary within a wide range. It is preferred, however, to have an angle of incidence within about 45° of the perpendicular. Most preferred is an essentially perpendicular angle of incidence.

The higher hydrogen components vaporize and disengage from the contact material. They are withdrawn immediately from the top of the contactor vessel through a multitude of contactor vapor outlet pipes. The contact time is such that no substantial thermal cracking of the charge occurs. This is generally on the order of less than 3 seconds, preferably less than 2 seconds and most preferably 1 second or less. The vapor pipes are purposely located in a preferred embodiment in the upper portion of the reactor vessel to insure no condensation of vapors before their quenching. However, any method which insures equal flow of vapors, minimum passage time from curtain of material to outlet and no condensation or cracking of vapors is acceptable.

In a preferred embodiment of the inventive apparatus, the vapor outlet pipes are situated at the top of the contactor in a location such that they are surrounded by hot contact material collected in a receptacle above the means for forming the curtain. In this manner, the heat of the contact material is used to maintain the vapors at a sufficiently high temperature to avoid their condensation in the outlet pipes. It is well known in the art that at temperatures above 700° F. condensed vapors are prone to conversion to coke. Passing the vapor outlet pipes through the contact material collector avoids this problem without the need to provide an additional heat source. It is of course to be understood that the invention contemplates the location of the vapor outlets at any other suitable location external to the curtain of contact material; these other embodiments, however, require an additional heat source, such as superheated steam, to maintain the vapor outlet pipes at a temperature above that at which the hydrocarbon vapors condense.

The continuously-moving bed of contact material at the bottom of the contactor is maintained at a very high level in order to reduce the size of the vaporization zone. In this manner, undesired cracking of the lower molecular weight hydrocarbons is minimized. Steam or gaseous hydrocarbon is introduced through what would correspond to the reactor vapor outlet in a system such as disclosed in U.S. Pat. No. 2,548,912. The lower section and bed thus are used as a stripper. An upward flow of steam or lower hydrocarbons is also used to strip off the entrained hydrocarbons and to vaporize the hydrocarbons left on the surface of the contact material by lowering the partial pressure of the hydrocarbons. The stripping media, after passing through the bed, exits with the hydrocarbon product vapors.

The contact material is then moved into a burner or "kiln" where the carbonaceous deposits are removed with oxygen through burning. Normally, the burner temperature will be less than 1600° F. and usually less than 1400° F. The burner may be of any suitable design as conventionally used for the combustion of catalytic or non-catalytic contact materials used in hydrocarbon conversion systems. Particularly suitable are those burners which operate countercurrent on air to contact material.

The heated contact material is conveyed to the top of the contactor through lift pipes. The resultant temperature of the contact material is about 100° F. lower than the burner temperature when it is dropped in the curtain around the oil inlet. In a preferred embodiment of the invention, bypass pipes are provided through the contactor vessel to allow for the passage of variable amounts (up to about 20–25%) of the contact material directly from the receptacle to the bed of contact material below the vaporization zone. These bypass pipes also allow for the control of the level of contact material in the bed below the vaporization zone. The use of the bypass pipes to feed heated contact material directly to the bed below permits the maintenance of this bed at a higher temperature than that of the contact material which falls to the bed in the form of the annular curtain. This higher temperature bed allows for heating the stripping media to a higher temperature than the hydrocarbon vapors and therefore minimizes condensation of hydrocarbon product vapors before quenching. This will also help minimize or eliminate coking in the product outlet lines. The contact material is transferred from the lift pipe to the contact material inlet by means of a disengager.

The oil, possibly with the addition of steam, water or hydrocarbon, is injected into the system between about 700° F. and 850° F. so that it is added at or close to its bubble point. The cycle is repeated continuously with addition of fresh contact material to control build up of metals on the contact material.

In order to disclose more clearly the nature of the present invention, the following drawings and examples illustrating specific embodiments of the invention are given. It should be understood, however, that this is done solely by way of example and is intended neither to delineate the scope of the invention nor limit the ambit of the appended claims.

DESCRIPTION OF SPECIFIC EMBODIMENTS

Figure 1:
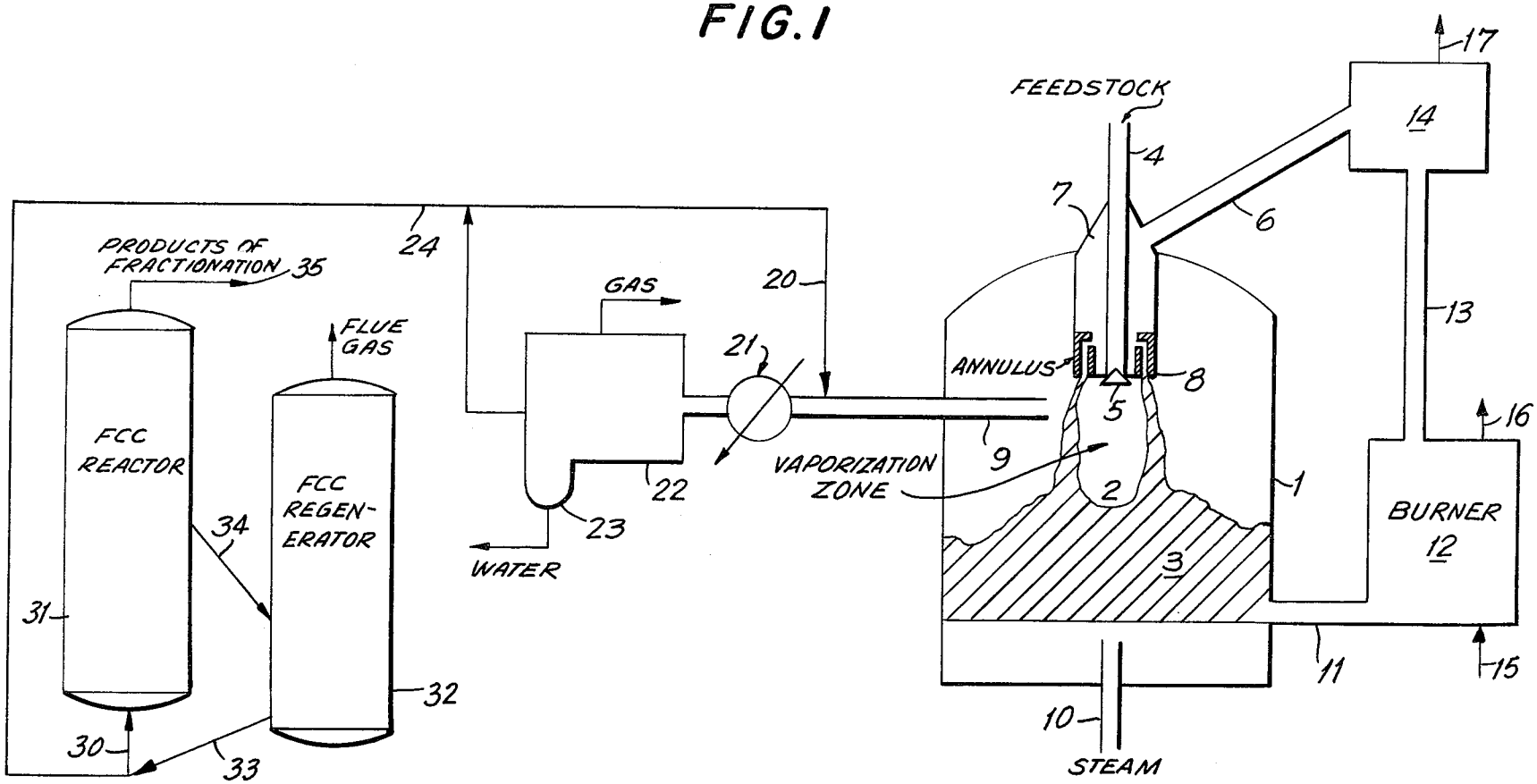
FIG. 1 illustrates an apparatus in diagramatic form suited to the practice of the invention.

As shown in FIG. 1, contactor housing 1 encloses both the vaporization zone 2 and the bed of contact material 3. Whole crude or a residual fraction enters through line 4 and is distributed horizontally by a feed distributor 5.

Heated solids of essentially inert character are supplied through line 6 to a receptacle 7. A curtain of heated solids is formed by a steady flow of the contact material through the solids annulus 8 and down to the bed of solids 3. The feed distributor 5 causes the feedstock to impinge on the curtain of heated solids essentially at a right angle. The feedstock passes rapidly through the curtain of heated solids and the high hydrogen components of the petroleum charge are vaporized upon contact with the curtain of solids. The vaporized fraction of the charge is collected by uniformly-spaced vapor outlets exemplified by line 9 and rapidly passes through a quenching means before any significant amount of thermal cracking occurs. Steam or gaseous hydrocarbon is introduced into the system through line 10 to reduce the partial pressures of the hydrocarbon components, thereby aiding in the stripping of the high boiling, low hydrogen components of the petroleum charge deposited on the contact material. After stripping of the contact material in bed 3, the material is passed through line 11 to burner 12, where the deposits are burned off and the temperature of the contact material is raised. The heated solids are recycled through line 13 to disengager 14 and then to inlet 6. Disengager 14 is vented to the atmosphere through gas outlet 17. The heat acquired during the burning process is used for vaporizing the hydrocarbon charge.

The burner 12, as noted above, may be any of the various structures developed for burning of combustible deposits on noncombustible solid materials. Air admitted to the burner 12 by line 15 provides the oxygen for combustion of the deposit on the inert solid, resulting in gaseous products of combustion discharged by flue gas outlet 16.

The burner 12 is preferably operated to maintain the temperature in the burner at its maximum, which is usually determined by metallurgical limitations. This may be accomplished, for example, by setting the temperature of the vaporization zone 2 to the minimum temperature which will provide the amount of fuel (as deposit on the inert solids) which sustains the maximum temperature of the burner. Since the circulation rate of the heated solids from the burner 12 to the contactor 1 and back of essentially inert character is relatively constant (in the range of 2 to 6 pounds of inert per pound of material feed), the actual temperature control of the contactor 1 is accomplished by varying the amount of feedstock and degree of vaporization and amount and temperature of the diluents, if any, used in the feedstock. A trend to lower temperature in the burner is compensated for by a decrease in the amount of diluent used or a decrease in the degree of feedstock vaporization. Inert solids heated by combustion in burner 12 may be stripped with steam in the burner 12 or the standpipe 13 before being returned eventually through inlet 6.

The vaporized hydrocarbons withdrawn from the system through the outlets exemplified by line 9 are then mixed with cold hydrocarbon liquid introduced by line 20 to quench thermal cracking. The quenched product is cooled in condenser 21 and passed to accumulator 22, from which gases are removed for fuel. Water, if any, is taken from sump 23, preferably for recycle to the contactor for generation of steam to be used as an aid in vaporizing charge in the vaporization zone 2 and/or removing heat from the burner. Condenser 21 is advantageously set up as a heat exchanger to preheat hydrocarbon charge to the contactor or to the FCC unit hereinafter described.

In one embodiment, the quenching is advantageously conducted in a column equipped with vapor-liquid contact zones such as disc and doughnut trays and valve trays. Bottoms from this column quencher could go directly to catalytic cracking with overhead passing to condenser 21 and accumulator 22. Water from sump 23 can be used as the stripping medium injected into line 10 at the bottom of the contactor housing 1.

Certain advantages can be realized in the system by using recycled light hydrocarbons at the bottom of contactor housing 1 for vapor pressure reduction. It will be apparent that recycle of water from accumulator 22 for that purpose requires that the effluent from the vaporization zone be cooled to the point of condensation of water. In the instant water vapor/hydrocarbon vapor system, this temperature is about 150° F. When hydrocarbons are used for vapor pressure reduction and as the stripping medium in line 10, condensation becomes unnecessary and the effluent (less the amount recycled for vapor pressure reduction and/or stripping) may be passed directly to a catalytic cracking reactor.

In this case, the vaporization zone functions as the catalytic cracker preheat furnace.

Similar advantage from the use of hydrocarbon recycle is realized when charging whole crude or topped crude through feedstock distributor 5 and passing the effluent to a fractionating column. In this case, the vaporization zone 2 and curtain of contact material function both as a crude furnace to preheat charge for the distillation stage and as a means for removing salts, metals and Conradson Carbon. Fractions from the crude still will include hydrocarbons for recycle, gasoline, kerosene, gas oil, and heavy bottoms for fuel, FCC charge or the like.

The light hydrocarbons will be chosen to boil below the contacting temperature in the contactor housing 1. These light hydrocarbons may be the gas fraction derived from the process or like hydrocarbon gas from other sources. Alternatively, the hydrocarbons used to aid in vaporization of the charge may be naphtha, kerosene or gas oil.

The liquid hydrocarbon phase withdrawn from accumulator 22 is a desalted, decarbonized, demetallized hydrocarbon fraction which is now a satisfactory charge for catalytic cracking. This product of contact with the curtain of contact material may be used in part as the quench liquid at line 20. The balance may be transferred directly to a catalytic cracker by line 24.

Although the system just described may bear a superficial resemblance to Houdresid catalytic cracking units such as disclosed in U.S. Pat. No. 2,548,912, the operation of the inventive system is very different from a unit of the latter type. The most significant difference is that the contact material is employed in such a manner so as to remove from the charge an amount not greatly in excess of the Conradson Carbon number of the feed. This contrasts with normal catalytic cracking "conversion" of 50–80%, measured as 100% minus the liquid volume percentage of product not boiling below 430° F. The present process, in contrast, removes only about 20% to 30% of the charge. The material removed from the feedstock comprises gas, naphtha and carbonaceous deposit (coke) on the solid contacting agent. Rarely will the amount removed from boiling range of the charge exceed a value by weight more than 3 to 4 times the Conradson Carbon value of the charge. This desirable result is due to the very low severity cracking because of the inert character of the solid and the very short residence time of the hydrocarbon charge at the cracking temperature. Cracking severity is well known to be a function of time and temperature; increased temperature may therefore be compensated for by reduced residence time, and vice versa.

The new process affords a control aspect not available in conventional FCC units through introduction and adjustment of the amount of liquid water, introduced via inlet 10. When processing stocks of high Conradson Carbon, the burner temperature will tend to rise because of an increased supply of fuel to the burner. The liquid water vaporizes in bed 3, removing heat through vaporization and reducing hydrocarbon partial pressure. Increasing the amount of liquid water introduced into the bed through line 10 compensates for an increase in burner temperature.

The contact with inert solids forming a curtain of contact material thus provides a novel sorption technique for removing the polynuclear aromatic compounds and metallic and salt components of crude oil and resids while these are carried in the stream of reduced hydrocarbon partial pressure resulting from supply of hydrocarbons or steam to the system.

The decarbonized, desalted and/or demetalized resid is good quality FCC charge stock and may be transferred by line 24 to feed line 30 of an FCC reactor 31 operated in a conventional manner. Hot, regenerated catalyst is transferred from FCC regenerator 32 by standpipe 33 for addition to the reactor charge. Spent catalyst from reactor 31 passes by standpipe 34 to the regenerator 32, while cracked products leave reactor 31 by transfer line 35 to fractionation for recovery of gasoline and other conversion products.

Figure 2:
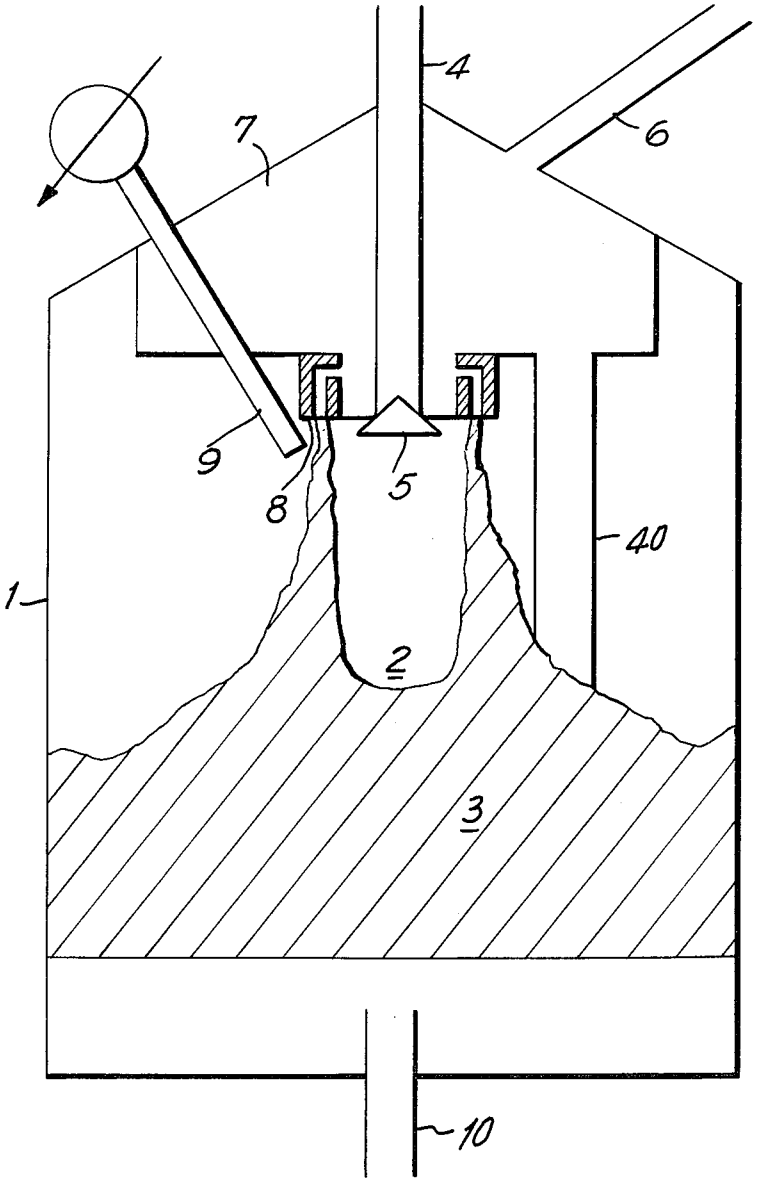
FIG. 2 illustrates a contactor modified according to preferred embodiments of the invention.

FIG. 2 illustrates two modifications of the inventive apparatus which further improve the efficiency of the upgrading process. In this embodiment, vapor outlet 9 passes through the contact material receptacle 7 before the line enters the contactor housing 1. In this manner, the heat of the regenerated contact material is conveniently employed to minimize condensation of the product vapors.

Bypass pipe 40 allows for the addition of heated contact material directly to bed 3 from receptacle 7 without its passage through the annulus 8. The temperature of the bed 3 may in this manner be maintained above that of the contact material which has formed the curtain. The high temperature of the bed facilitates stripping of the contact material effected by the steam or gaseous hydrocarbon introduced via line 10.

It is found that the nature of the selective vaporization is a function of temperature, total pressure, partial pressure of hydrocarbon vapors, residence time, charge stock and the like. One effect of temperature is a tendency to decrease the combustible deposit on the contact material as contact temperature is increased. Thus, greater portions of the charge are vaporized at higher temperatures. The secondary effect of thermal cracking of deposited hydrocarbons also increases at higher temperatures. These effects enhance the yield of product from the operation and reduce the fuel supplied to the combustion zone in the form of combustible deposit on the contact material.

In general, the temperature of selective vaporization will be above the average boiling point of the charge stock, calculated as the sum of the 10% to 90% points inclusive by ASTM distillation of the charge divided by 9. For the heavier stocks within the scope of the instant invention, the contact temperature will usually not be substantially below 1000° F. The temperature should, however, be maintained below the temperature at which severe cracking occurs to produce large yields of olefins. Even at residence times as short as 0.1 second or less, selective vaporization temperatures may be below about 1050° F.

In selective vaporization systems with an annular curtain thickness of several inches, significant vapor velocities exiting the feed distributor of less than 100 feet per second, and normally between 35 and 75 feet per second, and superficial velocities within the contactor housing of 0.5 to 10 feet per second, one can easily imagine contact times of less than 0.05 seconds for the lighter, more volatile feedstock components. The heavier, higher molecular weight and/or metal-bearing components of the feedstock remain in contact with the inert material somewhat longer than the higher hydrogen components. The contact time is sufficiently long to obtain the optimum degree of cracking.

In order to avoid or minimize the thermal cracking of the hydrocarbon feedstock, contact time in selective vaporization should not be substantially greater than about 3 seconds, and it is preferably much shorter, i.e., 1 second or less. A correlation of residence time and temperature provides conditions of low cracking severity. Under optimum conditions, the quantity of material removed from the charge is very nearly equal to the Conradson Carbon value of the charge. In all cases, this quantity will rarely exceed a value 3 to 4 times the CC of the charge. An additional advantage of the process is that the hydrogen content of the coke deposited on the inert solid contacting agent is significantly lower than that normally found in FCC or TCC-HCC coke.

The solid contacting agent is essentially inert in the sense that it induces minimal cracking of heavy hydrocarbons by the standard "CAT-D" test as modified herein. This test is conducted by measurement of the amount of gas oil converted to gas, gasoline and coke by contact with the solid in a fixed bed. The CAT-D test is a modification of the CAT-A method described by J. Alexander and H. E. Shimp, "Laboratory Method for Determining the Activity of Cracking Catalysts", National Petroleum News, p. R537 (Aug. 2, 1944).

In carrying out the modified CAT-D test, the feedstock is 44.0 grams of mid-Continent Gas Oil of 27° API with 10 weight percent of the charge as steam. This charge is contacted with 176 grams of steam-treated contact material during 300 seconds oil delivery time at 900° F. The steam treatment of the contact material may be carried out in a conventional manner, for example using 100% steam flowing through a fixed bed of contact material at 1450° F. and atmospheric pressure for 4 hours. The test is carried out in a system essentially as described by Clifford G. Harriz, "To Test Catalytic Cracking Activity", Hydrocarbon Processing, Vol. 45, No. 10, p. 183 (October 1966). This results in a catalyst to oil ratio of 4.0 at a weight hourly space velocity (WHSV) of 3.0. The contact materials employed according to the invention exhibit in this test a conversion of less than 20%, and preferably about 10%.

In contrast to U.S. Pat. No. 4,263,128 and U.S. application Ser. No. 299,361, the instant invention does not call for the use of a fluidizable contact material, such as microspheres of calcined kaolin clay. Instead, a preferred solid is a material with a substantially larger particle size. This material should have a conversion not substantially greater than 10% in the modified CAT D test. This is in contrast to the material typically used in a moving bed catalysis system, where materials with a conversion on the order of 65% are commonly used.

This preferred material may be further characterized by a bulk density of about 0.98 kg/l, a surface area of 20–50 $m^2/g$, a diameter of 0.145–0.157 inches and a length of 0.1–0.3 inches. The material of this type characteristically has a Mercury pore volume of 0.081 cc/g in the 30–200 Å range, 0.026 cc/g in the 200–400 Å range and 0.0161 cc/g in the 400–1000 Å range.

A preferred contact material is obtained from kaolin clay using a modification of a process as described in U.S. Pat. No. 3,367,886, in particular in Example VI of that patent. According to the modification, the following materials are mixed: MIN CHEM SPECIAL TM clay (2100 pounds); SATINTONE® 2 clay (150 pounds); SATINTONE® 1 clay (900 pounds); and sodium hydroxide solution at 20.5% by weight concentration (106.7 gallons). The ingredients are thoroughly mixed in a muller, adding water if necessary, to produce a mix having a consistency suitable for extrusion. This is then extruded under vacuum. The cylindrical extrudate is cut into pellets, which are transferred to vessels in which they are immersed in a hydrocarbon oil such as employed in Example 1 of U.S. Pat. No. 3,367,886. The pellets, covered with oil, are maintained at 100° F. for 36 hours and then heated at 200° F. for 24 hours. At this point in the processing, a zeolitic molecular sieve, identifiable by X-ray diffraction, is present. The oil is drained from the pellets, which are then washed to remove adherent oil.

The sodium content of the washed pellets is typically in the range of about 5–6 weight percent, calculated as $Na_2O$. The pellets are not, however, subjected to ion-exchange treatment to reduce the sodium content, as described in U.S. Pat. No. 3,367,886. The pellets are calcined in the presence of steam at about 1350° F. for 24 hours, in order to destroy the crystals of zeolite present in the pellets after the heat treatment. This results in the desired minimization, for purposes of the instant invention, of the catalytic activity of the pellet. Hardness of the pellets, as determined by the Air-Jet attrition method described in U.S. Pat. No. 3,367,887, is in the range of about 10 to 20 weight percent. SATINTONE® 1 and SATINTONE® 2 are calcined kaolin clays as described in U.S. Pat. No. 3,367,887; MIN CHEM SPECIAL TM is an uncalcined (hydrated) kaolin as described in the same patent. If pellets of even greater hardness are desired in order to minimize abrasion, these may be prepared, for example, by using as a starting material calcined kaolin clays of an even coarser particle size.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

We claim:

1. A process for upgrading a petroleum charge of a crude oil or a residual fraction thereof to provide a product with reduced heavy metal and Conradson Carbon content comprising the steps of:

(a) contacting said charge with a substantially inert heated contact material for a period of time less than three seconds and less than that which induces substantial thermal cracking of said charge by dispersing said charge into a curtain of descending contact material to vaporize the charge;

(b) removing immediately the vaporized hydrocarbon product generated thereby through means on the opposite side of said curtain of contact material from which said charge is dispersed without subjecting said product vapor to additional contact with said inert heated contact material before said removal; and (c) reducing the temperature of said vapors below that at which substantial thermal cracking of the product occurs.

2. A process as defined in claim 1, wherein said curtain of contact material is in annular form.

3. A process as defined in claim 1, wherein said contact material has a temperature of at least 800° F.

4. A process as defined in claim 1, wherein said period of time is less than 2 seconds.

5. A process as defined in claim 1, wherein said period of time is less than 1 second.

6. A process as defined in claim 1, wherein said contact material has a conversion rate not substantially greater than 20% in the modified CAT D test.

7. A process as defined in claim 6, wherein said contact material has a conversion rate not substantially greater than 10% in the modified CAT D test.

8. A process as defined in claim 1, further comprising the steps of regenerating said contact material by combustion of carbonaceous deposits thereon; and recycling said regenerated contact material into said curtain.

9. A process as defined in claim 8, further comprising the step of forming a bed with said contact material after it has descended in curtain form; and collecting said regenerated contact material in a receptacle prior to said recycling.

10. A process as defined in claim 9, further comprising the step of introducing through said bed a stripping medium countercurrent to said curtain of descending contact material.

11. A process as defined in claim 9, further comprising the step of introducing water through said bed to control the temperature of said regenerating step.

12. A process as defined in claim 9, further comprising the step of adding a portion of said regenerated contact material in said receptacle to said bed directly.

13. A process as defined in claim 12, wherein said portion comprises less than 20% of said contact material.

14. A process as defined in claim 1, wherein said dispersing is effected at an angle relative to said curtain within 45° of the perpendicular.

15. A process as defined in claim 1, wherein said dispersing is effected at an angle relative to said curtain which is essentially perpendicular.

16. A process as defined in either of claims 1 or 8, wherein said process is carried out continuously.

* * * * *